United States Patent [19]

Hudler et al.

[11] 4,099,619

[45] Jul. 11, 1978

[54] SORBENT BOOM WITH FLOTATION AND APPARATUS AND METHOD FOR STUFFING SAME

[75] Inventors: Charles William Hudler, Cloquet; Clare Eugene Swanson, White Bear Lake; George Holger Sundin, Duluth; Ilmer Issac Niemi, Cloquet, all of Minn.

[73] Assignee: Conwed Corporation, St. Paul, Minn.

[21] Appl. No.: 746,237

[22] Filed: Dec. 1, 1976

[51] Int. Cl.[2] ..... B65D 75/00

[52] U.S. Cl. ..... 206/524.1; 210/DIG. 26

[58] Field of Search ..... 206/83.5, 440, 438; 210/DIG. 26

[56] References Cited

U.S. PATENT DOCUMENTS 3,739,913 6/1973 Bogosian ..... 210/DIG. 26

FOREIGN PATENT DOCUMENTS 6,501,257 8/1966 Netherlands ..... 206/440

*Primary Examiner*—Robert I. Smith

*Attorney, Agent, or Firm*—Eyre, Mann, Lucas & Just

[57] ABSTRACT

A tube of flexible strands, closed at one end, is bunched up over a hollow mandrel. A sheet of sorbent material is slit into a plurality of strips before being forced through the mandrel into the tube by pull rollers.

The plurality of strips become folded in accordion pleats resembling ribbon candy having a large surface area as they are forced into the tube. As the tube becomes filled with strips it is forced off the mandrel. When full, the second end of the tube is closed. The finished, filled tube is useful as a sorbent for oil, especially oil on the surface of water. The buoyancy of the finished tube is varied by the inclusion of a buoyant strip.

3 Claims, 4 Drawing Figures

SORBENT BOOM WITH FLOTATION AND APPARATUS AND METHOD FOR STUFFING SAME

SUMMARY OF THE INVENTION

The present invention relates to an apparatus and method for making porous containers having openings large enough to allow substantially free passage of oil and water and containing sheets of flexible material which are oleophillic and hydrophobic. The preferred materials are fibrous sheets. More particularly it teaches an apparatus and method for stuffing flexible sheets of oil sorbent material into a net container.

The net container, closed at one end, is bunched up over a hollow mandrel. The flexible material is delivered to the apparatus in a continuous sheet, slit into strips by rotary slitting knives and forced through the hollow mandrel into the net container by rollers. As the strips are forced into the porous container, they fold upon themselves in accordion pleats much like ribbon candy and thus present a large surface area.

The pressure of the sorbent strips being forced into it, urges some of the container off the hollow mandrel to make room for additional sorbent material. At least a 10 foot length of flexible strip is forced into the container for each foot of container which is urged off the mandrel. When the last of the container is forced off the mandrel, the inner end is closed using, for example, a tie wire or tie string.

A resilient diaphram over the outside of the mandrel may be used to control the ease with which the container may be forced off the hollow mandrel. The greater the pressure required to force the container off the hollow mandrel, the greater the density of material in the porous container. Any convenient material and thickness may be used for the resilient diaphram with satisfactory results being obtained using rubber diaphrams of from 1/64 to ¾ inch thickness, but with best results being obtained with diaphram thicknesses from about 1/16 to about ¼ inch.

When the sorbent strips are composed of an oil sorbent material such as the material sold under the trademark CONWED manufactured by the Conwed Corporation of St. Paul, Minnesota, the container can be floated on the surface of water having an oil-contaminated layer to both contain the oil and to absorb and adsorb it. In this application, a number of the filled containers can be connected together to form a sorbent boom which can be placed encircling an oil spill or containing an industrial or municipal effluent. In one embodiment of the invention, a rope is deposited longitudinally within a tubular net as the tubular net is filled. The rope is useful to secure the individual filled containers together to form the boom.

A sorbent boom, especially when used in industrial plant effluent systems, may become contaminated with chemicals such as surfactants which reduce the buoyancy of the boom. Although the boom remains effective as a sorbent, its reduced buoyancy may allow it to sink through an overlying oil layer until it attains buoyant equilibrium at the oil-water interface. In cases of oil layers having thicknesses on the same order or larger than the diameter of the sorbent boom, the boom can be submerged out of sight and thus be difficult to retrieve. In addition, that portion of the boom which is below the oil-water interface is not exposed to the oil and is thus ineffective to capture oil. In one embodiment of the invention, a buoyant strip is stuffed into the container along with the sorbent strips. The buoyant strip adjusts the buoyancy of the boom to avoid submersion and to maximize exposure to oil. The buoyant strip can be any convenient width and thickness and of any convenient material but for sorbent boom applications for use in petroleum-water flotation, a width of from ¼ inch to a width equal to the unslit fibrous sheet and a thickness of 1/64 to ½ inch formed from sorptive olefin-based foam material is preferred with best results obtained with a thickness of from about 1/16 to about ⅜ inches, and a width of from about 1 to about 2 inches. When the buoyant strip is narrower than the strips of sorbent material, it can bypass the slitting knives and be passed directly between the pull rollers. When the buoyant strip is wider than the strips of sorbent material, it may be slit into narrower strips before being passed to the pull rollers. Alternatively, the buoyant material can be attached to or mixed into the sorbent sheet and thus be slit and stuffed into the container along with the sorbent material.

In one embodiment of the invention, the slitting knives are hingeably connected to a hold-down plate under which the sorbent sheet is passed to become slit into strips. When the hold-down plate is raised, for example to insert the end of a new fibrous sheet, the slitting knives are lowered below a protective surface. Thus the accident hazard of exposed slitting knives is automatically avoided.

DETAILED DESCRIPTION OF THE PREFERRED EMBODIMENT

Figure 1:
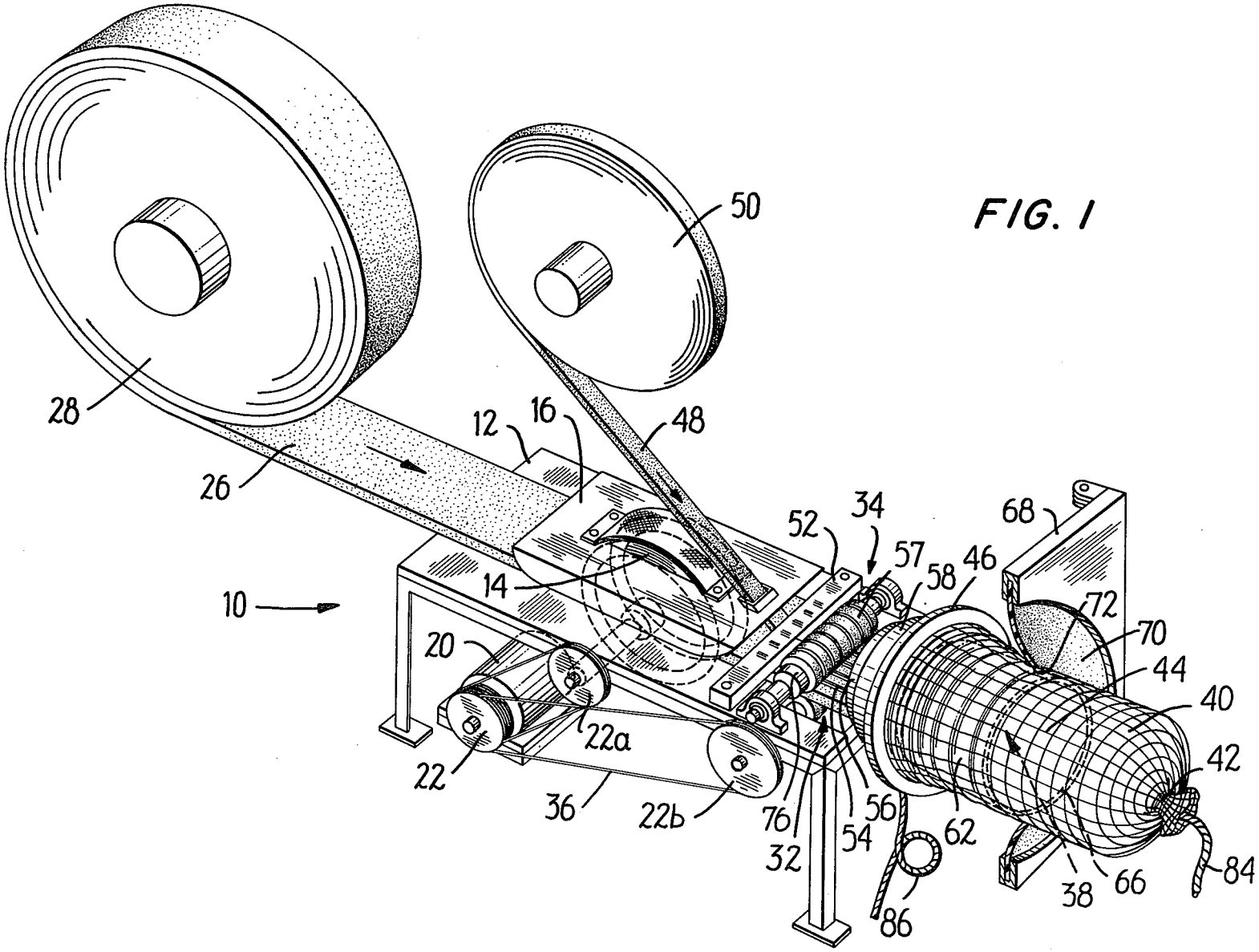
FIG. 1 shows a perspective view of one embodiment of the apparatus of the present invention.

Referring to FIG. 1, the boom stuffing apparatus 10 has a table 12 to which are mounted slitting knives 14. While these slitting knives may be razor blades or the like, it is preferred that they be rotatable discshaped knives, a secant of each of which protrudes through the surface of the table 12 as shown. A hold-down plate 16, having slots 18 (FIG. 2) fitting over the protruding secants of the slitting knives 14 is spaced above the surface of the table 12. The slitting knives 14 are rotated by power from a motor 20 transmitted to the slitting knives in any fashion as by pulleys 22, **22*a* and a belt 24**.

A sheet of oleophillic, hydrophobic material 26, preferably of the type manufactured and sold under the trade name CONWED is fed from a supply roll 28 between the surface of the table 12 and the underside of the hold-down plate 16 to the rotating slitting knives 14. The sheet of fibrous material 26 is slit into a plurality of narrower strips 30 (FIG. 2) which pass between a driven pull roll 32 (FIG. 3) and a pressure pull roll 34. The driven pull roll 32 is rotated by power from the motor 20 transmitted by any convenient method as by pulleys 22, **22*b* and belt 36**.

It is usually desirable in order to obtain clean cuts that the slitting knives 14 rotate at a higher velocity than the pull rolls 32, 34. This is suitably accomplished by the pulley **22*a* driving the slitting knives 14** having a smaller diameter than the pulley 22*b* on the driven pull roll 32. The pulley 22 at the motor 20 may have two different diameters to further increase the speed ratio. It will be obvious to one skilled in the art that two separate motors or other suitable means may be substituted for the single motor 20 shown.

After passing between the pull rolls 32, 34 the strips 30 are forced into a hollow mandrel 38. The mandrel 38 is preferably cylindrical and removeable from the apparatus as will be explained. The mandrel 38 is prepared for use by bunching up a net tube 40 closed at its outer end 42 over its outer surface until the outer end 42 is stretched across the exit orifice 44 of the mandrel 38. An annular flange 46 on the mandrel 38 provides a stop against which the net tube 40 can be bunched up.

A strip of buoyant material 48, such as an oleosorptive olefin foam fed from a supply roll 50, may be inserted into the net tube 40 to adjust the buoyancy of the finished product. The strip of buoyant material 48 may be fed directly to the pull rolls 32 (FIG. 3), 34 without first passing through the slitting knives 14 and thereby forced into the net tube 40 along with the strips 30 (FIG. 2) of fibrous material.

Figure 2:
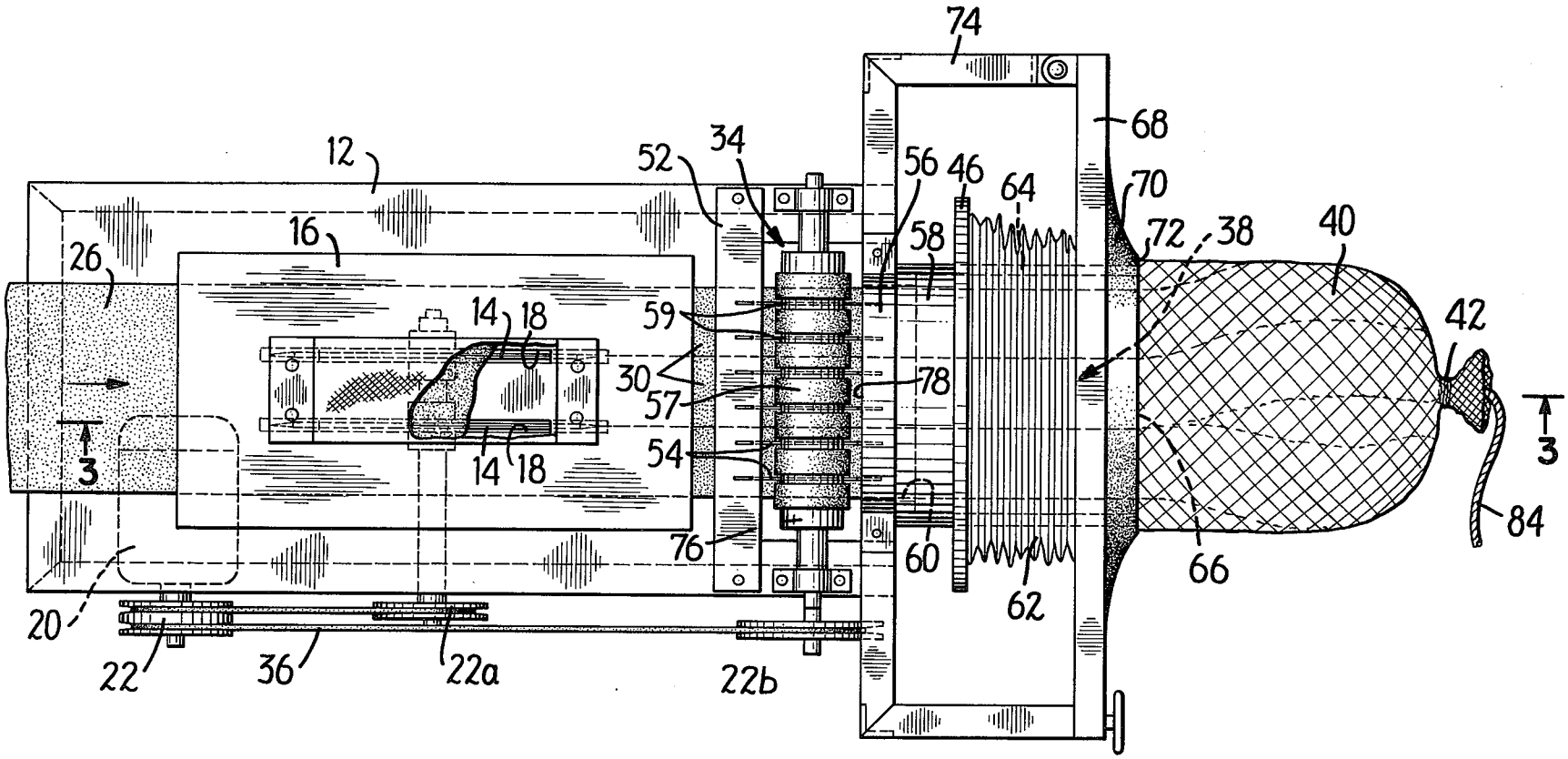
FIG. 2 shows a plan view of the apparatus of FIG. 1.

Referring now to the plan view in FIG. 2, before the strips 30 reach the pull rolls 32 and 34, they pass under an upper guide wire support bar 52. At least two upper guide wires 54 per strip 30 are connected from the upper guide wire support bar 52, between the pull rolls 32 and 34, to the top of the mouth of the discharge tube 56. A discontinuous sleeve of cuffs 57, suitably of rubber, foam rubber, foam plastic or other material, encircle the pressure pull roll 34 except for the area of the upper guide wires 54. The upper guide wires 54 thus pass through notches 59 between the cuffs 57. An opposing set of cuffs and notches are located on the driven pull roll 32 (not shown in FIG. 2).

A similar set of lower guide wires to be described later are attached in opposing positions to the upper guide wire 54 through notches in the driven pull roll 32 to the bottom of the mouth of the discharge tube 56. The upper and lower guide wires positively channel the strips 30 through the pull rolls 32 and 34 and into the discharge tube 56.

A cylindrical rear projection 58 on the mandrel 38 is slideably installed over a cylindrical flange 60, shown by dashed lines, on the discharge tube 56. The mandrel 38 is retained in this position suitably by latches or the like, (not shown).

A bunched up mass 62 of the net tube 40 is located on the forward cylindrical portion 64 of the mandrel 38 between the annular flange 46 and the outboard end 66 of the mandrel 38. The bunched up mass 62 is much like a knee sock which is being put on and which is only over the toes. A rigid ring 68 having a central resilient diaphram 70 containing an axial circular aperture 72 is hingeably attached to a support arm 74. When rotated to and latched in the operating position as shown, the aperture 72 of the resilient diaphram 70 fits over the outboard end 66 of the mandrel 38 and bears resiliently against the net tube 40 as it passes over the mandrel 38 outboard of the bunched up mass 62. The resilient pressure of the resilient diaphram 70 increases the force required to withdraw the net tube 40 from the mandrel 38. Numerous other tensioning devices such as fingers or springs could be substituted for the resilient diaphram 70 without departing from the scope of this invention. Alternatively this element could be eliminated completely by employing a net tube which can be tensioned over the mandrel, e.g., one made at least in part of an elastomeric material.

Figure 3:
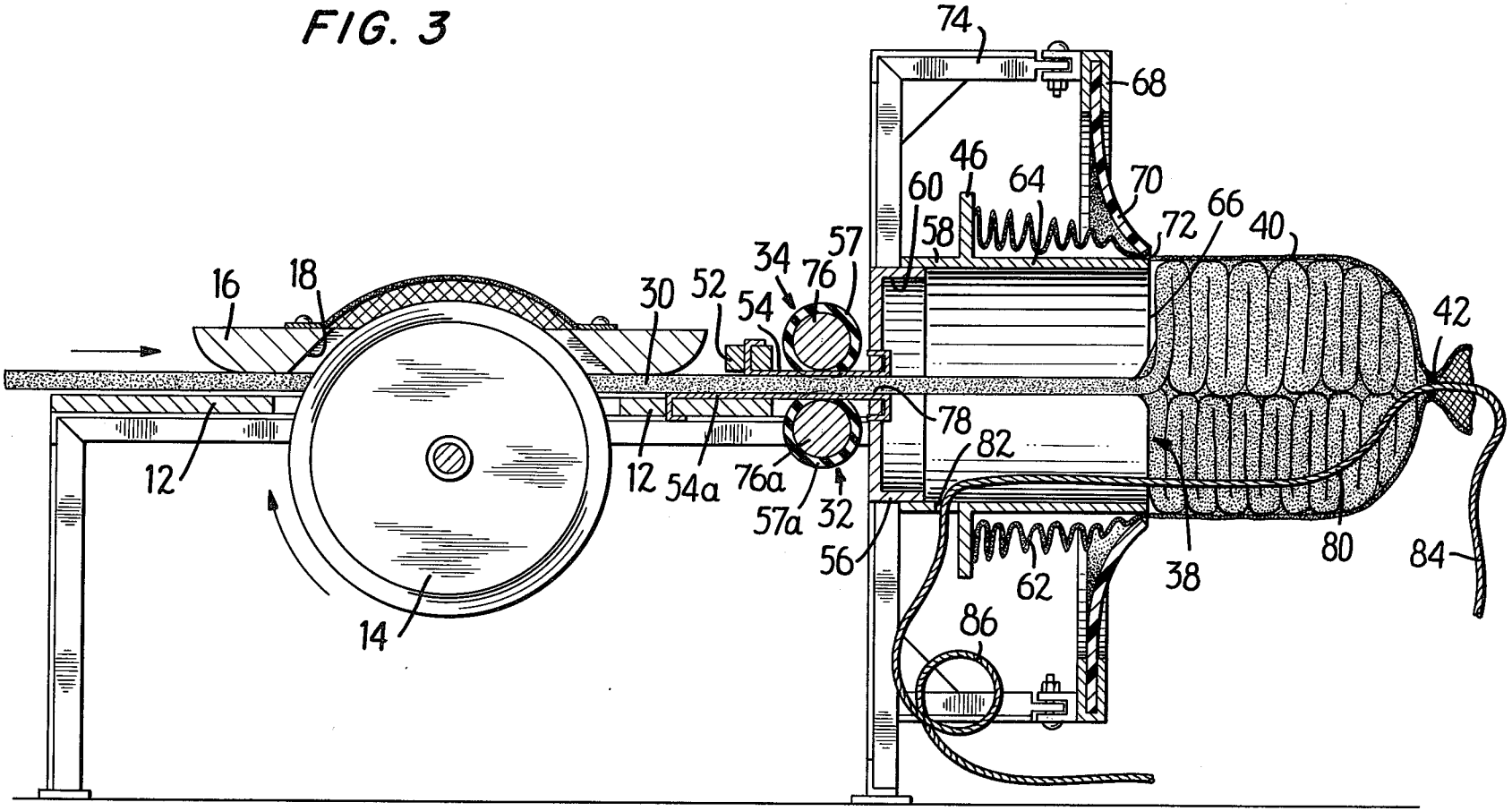
FIG. 3 shows a sectional view taken along 3—3 in FIG. 2.

The cross sectional drawing in FIG. 3 discloses additional features of the embodiment of the invention. The pressure pull roll 34 is composed of a solid core 76 encircled by the resilient cuffs 57 as previously described. The upper guide wires 54 extend from the underside of the upper guide wire support bar 52, tangent to the solid core 76 and into the top of the mouth 78 of the discharge tube 56. Similarly the opposing lower guide wires 54*a* extend from the top of the table 12, tangent to the solid core 76*a* of the driven pull roll 32 and into the bottom of the mouth 78 of the discharge tube 56. The resilient cuffs 57 and 57*a* extend beyond the guide wires 54, 54*a* to bear firmly on the strips 30. It is thus seen that, as the pull rolls 32 and 34 force the strips 30 between them, the strips 30 are positively guided between the upper and lower guide wires 54 and 54*a* and are forced through the mouth 78 of the discharge tube 56. This applies outward force on the net tube 40 thereby urging some of the net tube 40 in the bunched up mass 62 past the resilient diaphram 70. This process continues until all of the net tube 40 has been urged past the resilient diaphram 70 and is filled with convoluted fibrous strips 30. The inboard end of the net tube 40 may then be closed in the same manner as the outboard end 42.

A tension rope 80 may optionally be automatically included in the net tube 40 during the stuffing operation. The rope 80 is fed through a rope feed hole 82 in the cylindrical rear projection 58 on the mandrel 38, and through the outboard end 42 of the net tube 40. The means of closing the outboard end 42 may also secure the rope 80. A protruding part 84 of the rope 80 may be made into a loop or may be otherwise used to connect the end of the finished article to another object. The bight 86 of the rope 80 is initially outside of the rope feed hole 82. As the net tube 40 becomes filled and elongated, the rope 80 is drawn into the net tube 40. When the net tube 40 is filled and the inboard end closed, a length of rope protrudes therefrom and the closure may secure the inboard end of the rope 80 in the same manner described for the outboard end.

Figure 4:
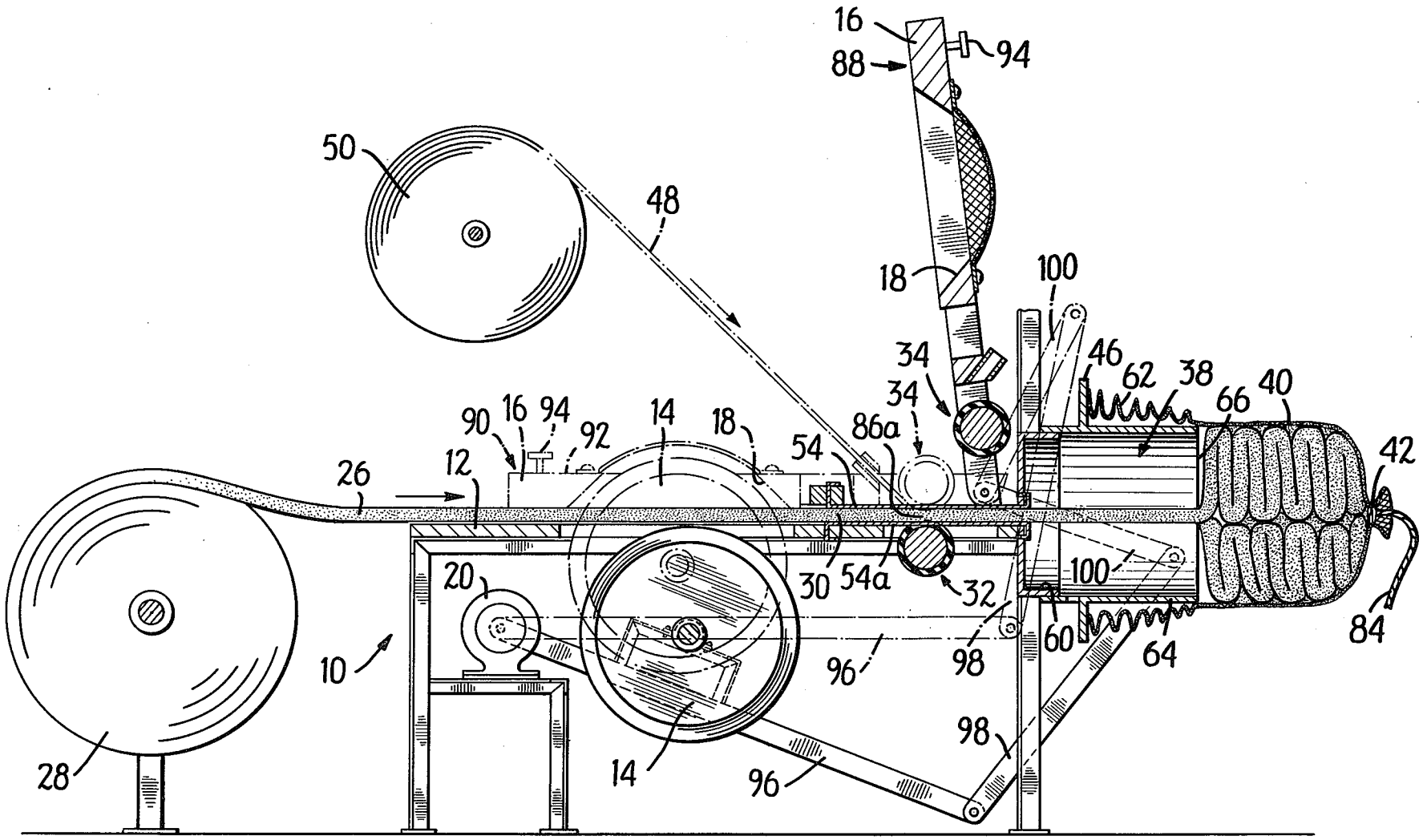
FIG. 4 shows a side view partially cut away to reveal a safety device for lowering the slitting knives while loading the apparatus.

In the embodiment shown in FIG. 4, the hold-down plate 16 is hingedly attached to the table 12 to enable initial feeding of the sheet of fibrous material 36. The pressure pull roll 34 is mounted in the hinged frame of the hold-down plate 16 and is thus hingedly elevated whenever the hold-down plate 16 is raised. The hold-down plate 16 also has an angled channel 86*a* adjacent to the pressure pull roll 34 through which the strip of buoyant material 48 can be fed.

In the open position of the hold-down plate 16 shown at 88, the sheet of fibrous material 26 can be positioned between the guide wires and over the driven pull roll 32. In addition, the strip of buoyant material 48 can be similarly fed through the channel 86*a*, between the guide wires and over the driven pull roll 32.

When the hold-down plate 16 is hinged into the closed position, shown at 90, the sheet of fibrous material 26 and the strip of buoyant material 48 are firmly pressed between the driven and pressure pull rolls 32 and 34.

The slots 18 in the hold-down plate 16 pass over the exposed secant of the slitting knives 14. A protective layer of suitable material, such as expanded metal sheet, may be affixed to the top 92 of the hold-down plate 16 to prevent accidental worker contact with the slitting knives 14. The hold-down plate 16 is secured in the closed position 90 by a latch 94 of a type well known in the art.

The slitting knives 14 and the motor 20 are mounted on a pivoted support beam 96. The support beam 96 is pivoted at the axis of the motor and is pivotably supported at its other end by an actuator bar 98. The actuator bar 98 is pivotably connected to a lever 100 which is rigidly connected at its other end to the hold-down plate 16. The mechanism just described is shown in the positions assumed when the hold-down plate 16 is in its closed position 90.

When the hold-down plate 16 is moved from its closed position 90 to its open position 88, the rotation of the lever 100 allows the actuator bar 98 to move downward. This causes the support beam 96 to rotate clockwise about its axis at the axis of the motor 20. The slitting knives 14, mounted on the support beam 96 are lowered until they no longer protrude through the table 12. The sharp perimeters of the knives 14 are thus not exposed to accidental contact with the workers when the hold-down plate 16 is raised in the open position.

It will be understood that the claims are intended to cover all changes and modifications of the preferred embodiments of the invention, herein chosen for the purpose of illustration which do not constitute departures from the spirit and scope of the invention.

What is claimed is:

1. A floatable sorbent boom comprising:

(a) a porous flexible, tubular, mesh-like cover having a length at least 10 times its width and having first and second closed ends, said cover having openings large enough to allow substantially free passage of oil and water therethrough;

(b) at least one flexible strip of substantially oleophilic and substantially hydrophobic sorbent material within said cover;

(c) said at least one strip having a length at least 10 times the length of the said cover and a minimum length of at least 10 feet, a width from about ¼ inch to substantially equal to the width of the cover and a thickness of from about 1/64 to about ½ inch; and (d) said at least one strip being folded in pleated fashion with the pleats being transverse to the longitudinal axis of the cover.

2. The floatable sorbent boom recited in claim 1 further comprising at least one strip of olefin buoyant material in said porous cover said strip of buoyant material being at least ¼ inch wide, and from about 1/64 to about ½ inch thick.

3. The floatable cylinder recited in claim 1 further comprising a rope entering at said first closed end, passing along the length thereof and exiting at said second closed end.

* * * * *